US010413095B2

(12) United States Patent
Strassburger et al.

(10) Patent No.: US 10,413,095 B2
(45) Date of Patent: Sep. 17, 2019

(54) EARRING SECURITY DISPLAY HANGER

(71) Applicant: B&G Plastics, Inc., Union, NJ (US)

(72) Inventors: Jacob Strassburger, South Plainfield, NJ (US); Alex Tetiyevsky, Sarasota, FL (US); Daniel V. Cunneen, Waldwick, NJ (US)

(73) Assignee: B&G Plastics, Inc., Union, NJ (US)

( * ) Notice: Subject to any disclaimer, the term of this patent is extended or adjusted under 35 U.S.C. 154(b) by 32 days.

(21) Appl. No.: 15/719,646

(22) Filed: Sep. 29, 2017

(65) Prior Publication Data

US 2019/0099015 A1 Apr. 4, 2019

(51) Int. Cl.

| | |
|---|---|
| ***A47F 7/024*** | (2006.01) |
| ***B65D 73/00*** | (2006.01) |
| ***A47F 5/00*** | (2006.01) |

(52) U.S. Cl.

CPC ..... *A47F 7/024* (2013.01); *A47F 5/0006* (2013.01); *B65D 73/005* (2013.01); *B65D 73/0014* (2013.01)

(58) Field of Classification Search

CPC ... A47F 7/024; A47F 5/0006; B65D 73/0014; B65D 73/005

USPC ..... 206/6.1, 566, 806, 807, 1.5, 495, 289, 206/292, 293, 288, 285, 284, 487, 482, 206/489, 488, 493, 477, 480, 467, 471, 206/483, 470; 223/87, 91; 70/57.1, 58, 70/14; 211/85.2, 113, 4, 8

See application file for complete search history.

(56) References Cited

U.S. PATENT DOCUMENTS

| | | | | |
|---|---|---|---|---|
| 3,487,984 | A * | 1/1970 | Loscalzo | A47G 25/487 223/96 |
| 4,714,156 | A * | 12/1987 | Kolton | A47G 25/14 206/278 |
| 4,765,467 | A | 8/1988 | Kolton et al. | |
| 4,768,649 | A | 9/1988 | Kolton et al. | |
| 4,930,692 | A | 6/1990 | Smilow et al. | |
| 5,110,019 | A | 5/1992 | Kolton et al. | |
| 5,123,577 | A | 6/1992 | Kolton et al. | |
| 5,215,700 | A * | 6/1993 | Garganese | A47F 7/02 206/486 |
| 5,219,071 | A * | 6/1993 | Knapp | A45C 11/16 206/479 |
| 5,222,638 | A | 6/1993 | Kolton et al. | |
| 5,328,065 | A | 7/1994 | Kolton et al. | |
| 5,501,378 | A | 3/1996 | Kolton et al. | |
| 5,582,387 | A | 12/1996 | Kolton et al. | |

(Continued)

*Primary Examiner* — Jacob K Ackun
*Assistant Examiner* — Jenine Pagan
(74) *Attorney, Agent, or Firm* — Hoffmann & Baron, LLP

(57) ABSTRACT

An earring security display hanger includes a generally flat body member, first and second arms, and first and second closure members. The body member has a first end, a second end, first and second sides extending from the first and second ends, a first edge, and a second edge. The first and second arms extend longitudinally from the first and second edges of the body member, respectively. The first and second closure members, having a plurality of closure apertures, are connected to the body member by the first and second arms, respectively. A plurality of first closure hooks and a plurality of second closure hooks are formed integrally from the first side of the body member and are configured to engage with the plurality of closure apertures to provide a locking mechanism.

13 Claims, 7 Drawing Sheets

(56) References Cited

U.S. PATENT DOCUMENTS 5,615,810 A 4/1997 Kolton et al.
5,664,669 A * 9/1997 VanFleet ..... A47F 5/0006 206/459.5
5,826,760 A 10/1998 Kolton et al.
5,988,462 A 11/1999 Kolton
6,073,758 A 6/2000 Webster et al.
6,182,824 B1 * 2/2001 Kolton ..... B65D 33/14 206/278
6,206,253 B1 3/2001 Kolton et al.
6,264,077 B1 7/2001 Kolton et al.
6,561,358 B2 5/2003 Kolton et al.
7,143,892 B2 12/2006 Kolton et al.
7,448,520 B2 11/2008 Kolton et al.
8,286,882 B2 10/2012 Norman et al.
8,308,291 B2 11/2012 Norman et al.
8,651,344 B2 2/2014 Norman et al.
8,752,406 B2 * 6/2014 Shute ..... E05B 73/0017 206/6.1
9,480,347 B2 11/2016 Strassburger et al.
9,585,496 B2 3/2017 Strassburger et al.
2005/0099303 A1 * 5/2005 Zuckerman ..... A47G 25/1407 340/572.8
2006/0021889 A1 * 2/2006 Kim ..... A45C 11/00 206/320
2012/0043228 A1 * 2/2012 Ezzo ..... A47F 7/024 206/1.5
2015/0102190 A1 * 4/2015 Fiumefreddo ..... A47F 7/16 248/215
2015/0272364 A1 * 10/2015 Larsen ..... A47G 25/14 223/96
2015/0297011 A1 * 10/2015 Jones ..... A47G 25/1407 223/85
2016/0058209 A1 3/2016 Strassburger et al.
2017/0253408 A1 9/2017 Strassburger
2018/0087293 A1 * 3/2018 Strassburger ..... A47G 25/005

* cited by examiner

EARRING SECURITY DISPLAY HANGER

FIELD OF THE INVENTION

The present invention relates to earring display hangers, and more particularly, to earring security display hangers with a theft deterrent locking mechanism.

BACKGROUND OF THE INVENTION

Earrings are commonly displayed for sale in retail stores on racks or in display cases where the earrings are hung. A variety of different hangers and tags have been used to secure small articles and to be suspended on a hook or the like, such as a pegboard hook for retail display. Because of earring's relative small size, it is hard to track each of them and can easily be stolen by consumers without security tags. The security tags can be enclosed in or attached to a variety of different devices, such as holder or housing, which accommodate the electronic tag and are used to attach the tags to article. This presents both manufacturing and assembling issues, which increase the cost and product complexity.

Accordingly, there is a need for an improved earring display hanger to prevent theft by consumers.

SUMMARY OF THE INVENTION

According to an embodiment of the present invention, an earring security display hanger includes a generally flat body member, first and second arms, and first and second closure members. The body member has a first end, a second end, first and second sides extending from the first and second ends, a first edge, and a second edge. The first and second arms extend longitudinally from the first and second edges of the body member, respectively. The first and second closure members, having a plurality of closure apertures, are connected to the body member by the first and second arms, respectively. A plurality of first closure hooks and a plurality of second closure hooks are formed integrally from the first side of the body member and are configured to engage with the plurality of closure apertures to provide a locking mechanism.

These and other aspects of the present invention will be better understood in view of the drawings and following detailed description.

DETAILED DESCRIPTION OF PREFERRED EMBODIMENTS

Figure 1:
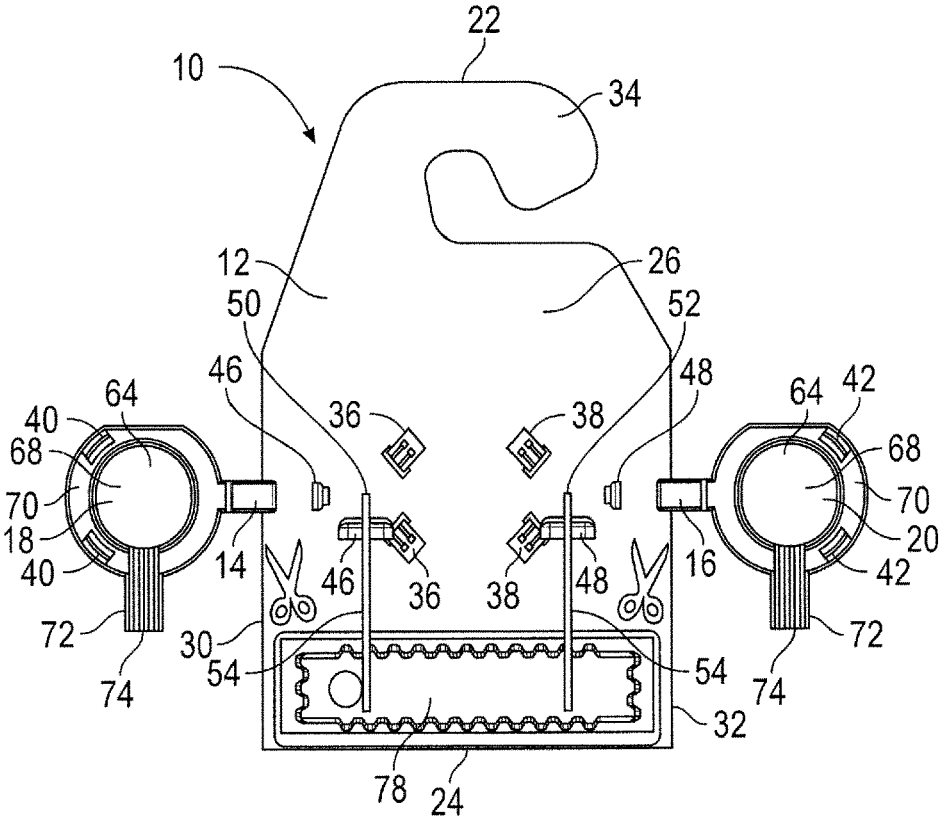
FIG. 1 is a rear view of the earring security display hanger, according to an embodiment of the present invention, in an unlock/open position.
Figure 2:
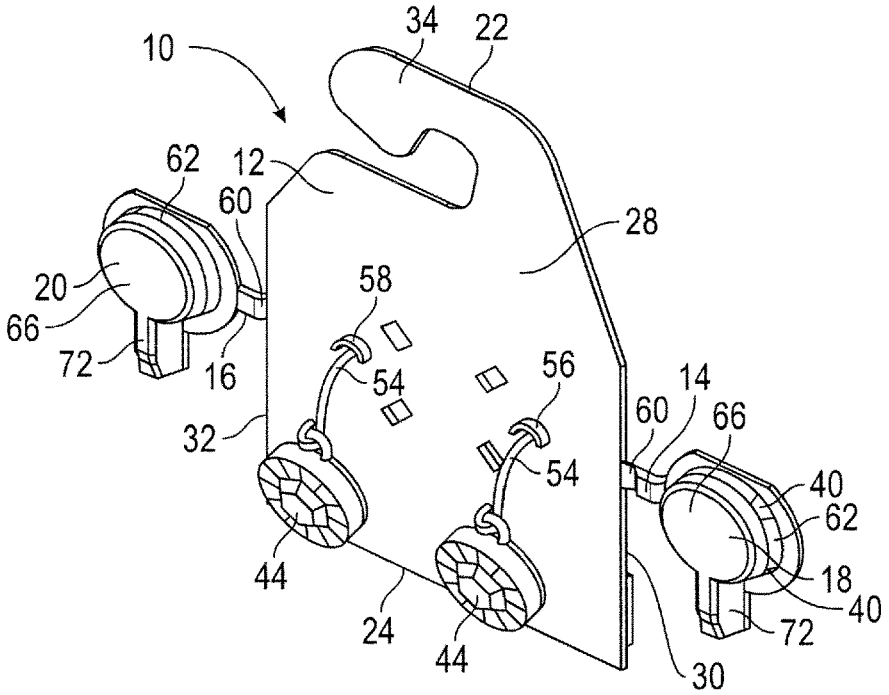
FIG. 2 is a perspective front view of the earring security display hanger in FIG. 1.
Figure 3:
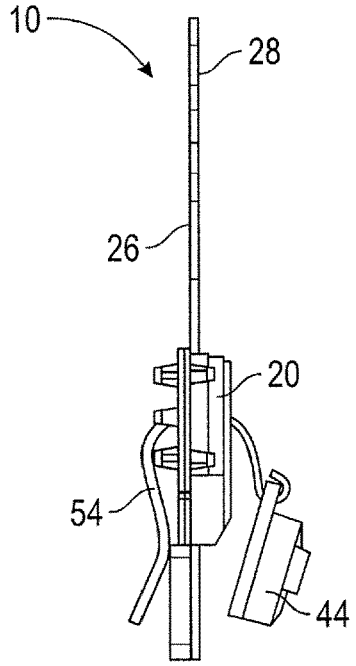
FIG. 3 is a side view of the earring security display hanger in FIG. 1.

According to an embodiment of the present invention, referring to FIGS. 1-3, an earring security display hanger 10 includes a body member 12, first and second arms 14, 16, and first and second closure members 18, 20. The first and second closure members 18, 20 are connected to the body member 12 via the first and second arms 14, 16, respectively.

Referring again to FIGS. 1-3, the body member 12 is generally flat and includes a first end 22, a second end 24, first and second sides 26, 28 extending from the first and second ends 22, 24, a first edge 30, and a second edge 32. A display hanger hook 34 is positioned at the first end 22. A plurality of first closure hooks 36 and a plurality of second closure hooks 38 are formed integrally from the first side 26 of the body member 12 and protrude outwardly therefrom. The plurality of first and second closure hooks 36, 38 are designed and configured to be inserted through a plurality of first and second closure apertures 40, 42 of the closure members 18, 20 to provide a locking mechanism to secure earrings 44, as will be described in greater details below.

A plurality of first ribs 46 and a plurality of second ribs 48 are also formed integrally from the first side 26 of the body member 12 adjacent to the plurality of first closure hooks 36 and the plurality of second closure hooks 38, respectively, and protrude outwardly therefrom. The body member 12 defines first and second earring holes 50, 52, which are positioned close to the plurality of first ribs 46 and the plurality of second ribs 48, respectively, through which an earring hook 54 could be inserted. In addition, first and second curved ribs 56, 58 are formed integrally from the second side 28 of the body member 12 immediately above the first and second earring holes 50, 52, respectively, and protrude outwardly therefrom.

The first and second arms 14, 16 extend longitudinally approximately from the middle of the first and second edges 30, 32 of the body member 12, respectively. Each of the first and second arms 14, 16 includes a foldline 60 such as crease, to allow each closure member 18, 20 to be folded along the foldline 60 to transition the earring security display hanger 10 between open/unlocked (FIGS. 1-3) and closed/locked positions (FIGS. 4-7). When the earring security display hanger 10 is fully assembled and is in the closed/locked position as shown in FIG. 5, the earrings 44 can be displayed from the second side 28 of the body member 12.

Figure 4:
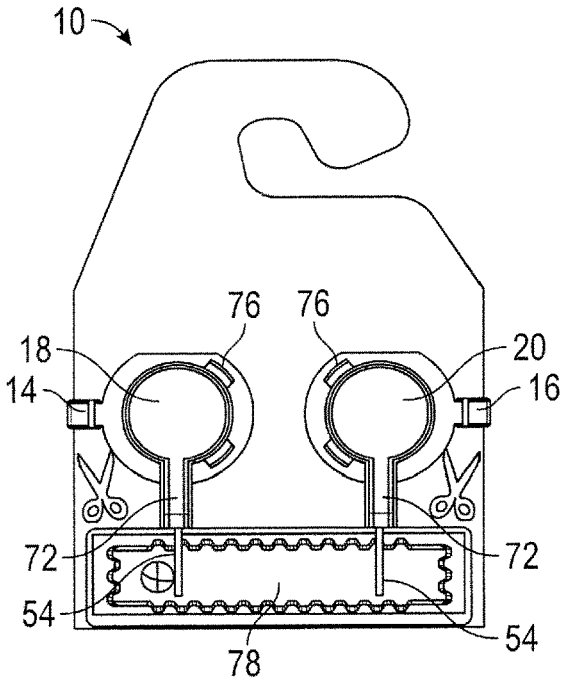
FIG. 4 is a rear view of the earring security display hanger in FIG. 1 in a locked/closed position.
Figure 5:
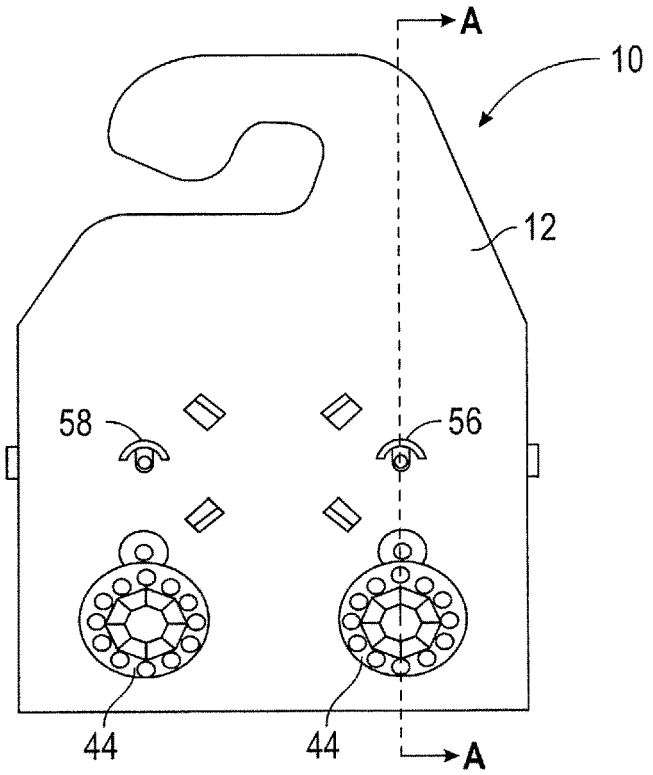
FIG. 5 is a front view of the earring security display hanger in FIG. 4.

Referring to FIGS. 1, 2, and 4, each of the first and second closure members 18, 20 has a generally round cross section and includes a sidewall 62 extending between open and closed ends 64, 66, defining a closure member volume 68 therebetween. Each of the open ends 64 has a flange 70 formed thereabout, which engages with the first side 26 when the earring security display hanger 10 transitions to the closed/locked position from the open/unlocked position. A closure channel 72 is integrally formed from the bottom of each of the first and second closure members 18, 20 and extends downwardly therefrom. The closure channel 72 defines a channel groove 74 such that, in the closed/locked position, a bottom portion of the earring hook 54 can be placed therewithin, as illustrated in FIG. 4.

Figure 6:
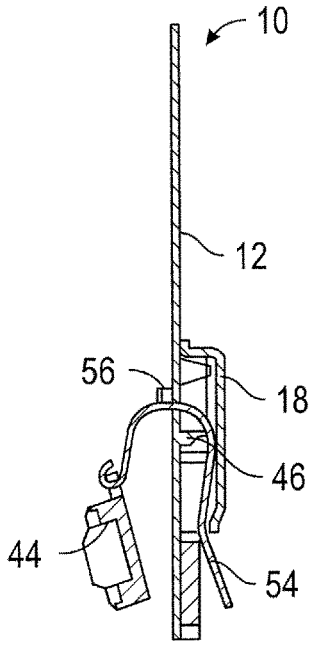
FIG. 6 is a sectional view taken along line A-A of FIG. 5.
Figure 7:
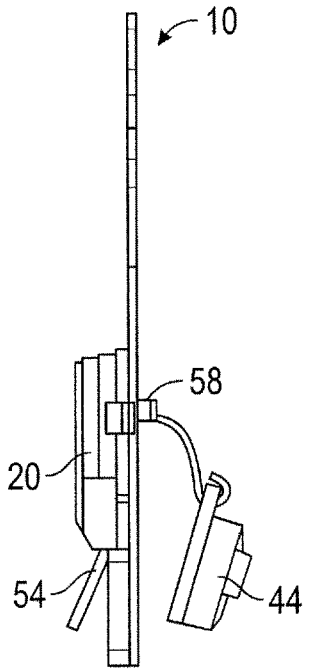
FIG. 7 is a side view of the earring security display hanger in FIG. 4.
Figure 8:
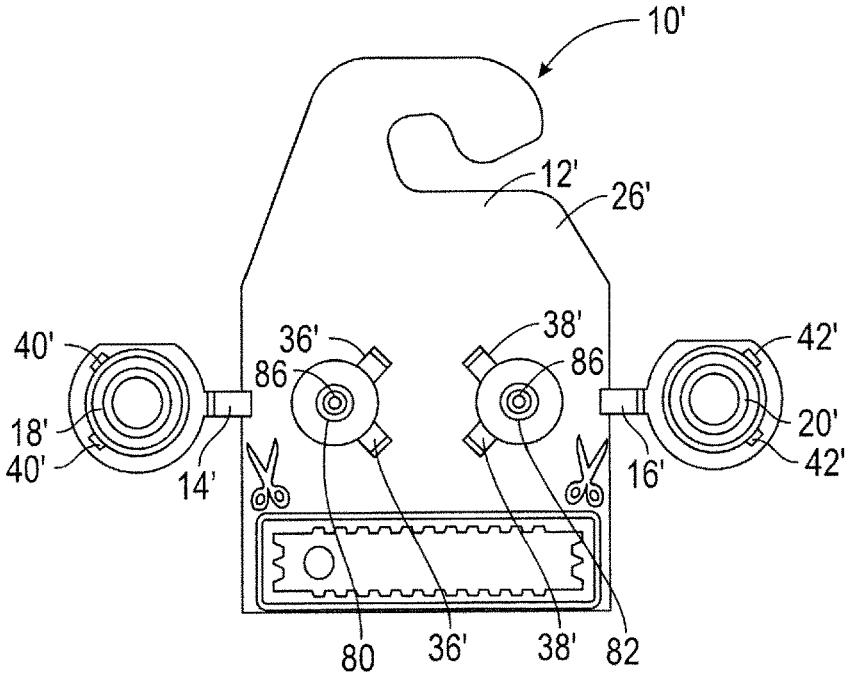
FIG. 8 is a rear view of the earring security display hanger, according to another embodiment of the present invention, in an unlocked/open position.

The plurality of first and second closure apertures 40, 42 are defined on the sidewall 62, through which the plurality of first and second closure hooks 36, 38 could be inserted, respectively. Contours of the plurality of first and second closure apertures 40, 42 and the plurality of first and second closure hooks 36, 38 are designed and configured such that, when engaged, they provide a locking mechanism, with a tip 76 of each closure hook 36, 38 protruding outwardly from each closure aperture 40, 42 and engaging tightly with the flange 70, as illustrated in FIG. 4. Once the earring security display hanger 10 is in the locked/closed position, it is extremely difficult to open the first and second closure members 18, 20 with bare hands to separate the earrings 44 therefrom. In fact, the locked earring security display hanger 10 is not readily openable without destruction of the hanger 10. In addition, since an inner surface of each of the first and second closure members 18, 20 presses a portion of each of the earring hooks 54 against the corresponding rib 46, 48 and the curved ribs 56, 58 prevent from lifting and bending the earring hooks 54, as shown in FIG. 6, it is also difficult to pull the earrings 44 out of the earring security display hanger 10.

It is contemplated that a security tag or marker 78 may be applied to the first or second side 26, 28 of the body member 12. In addition to the security tag 78, other pictures such as logos or text (including product descriptions) may be printed on, embossed in, or otherwise attached to the first or/and second side(s) 26, 28 of the body member 12.

The security tag 78 attached to the earring security display hanger 10 has a wide variety of uses, including tracking, inventory control, and security. The security tag 78 can also provide electronically readable information pertaining to the earrings 44. The security tag 78 is a radio frequency identification (RFID) tag, an electronic article surveillance (EAS) device or the like. The security tag 78 is firmly secured to the earring security display hanger 10 such that it remains with the earrings 44 until after the time of purchase.

Figure 12:
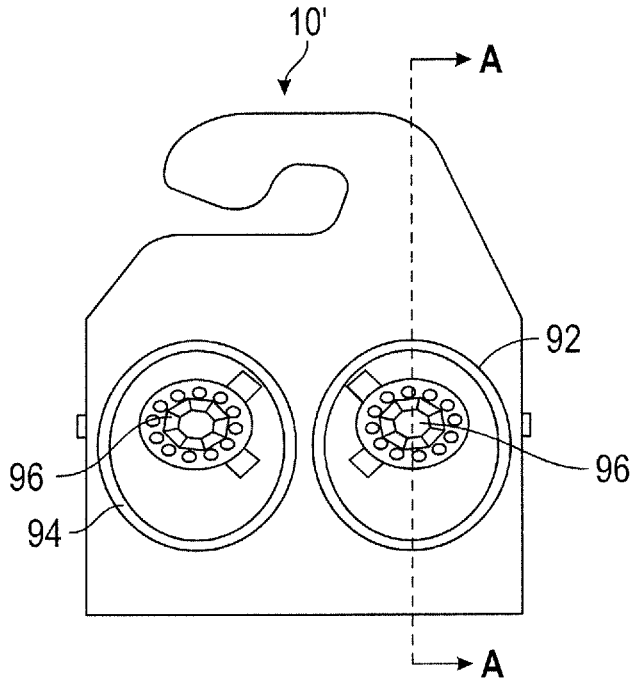
FIG. 12 is a front view of the earring security display hanger in FIG. 11.
Figure 13:
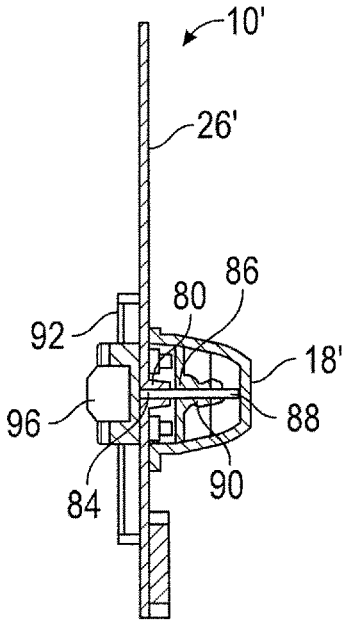
FIG. 13 is a sectional view taken along line A-A of FIG. 12.
Figure 14:
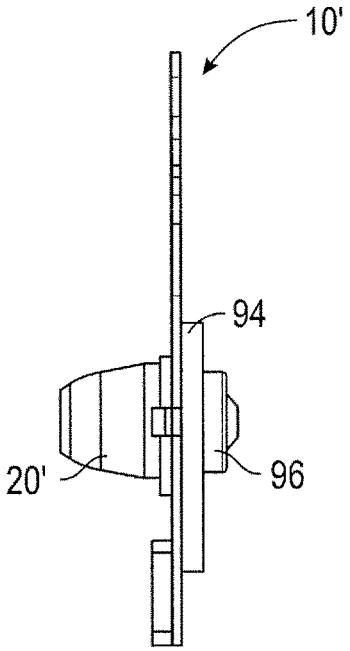
FIG. 14 is a side view of the earring security display hanger in FIG. 11.

Referring to FIGS. 8-14, in an alternate embodiment, an earring security display hanger 10' includes first and second closure members 18', 20' having a flat top cone shape with a generally round cross section. First and second post receivers 80, 82 are formed integrally from the first side 26' of the body member 12' and extend between first and second openings 84, 86 such that they provide adequate friction fit for earring posts 88, as illustrated in FIG. 13. Once the earring post 88 is inserted from the first opening 84, an earring back 90 can be inserted and placed thereto.

Figure 9:
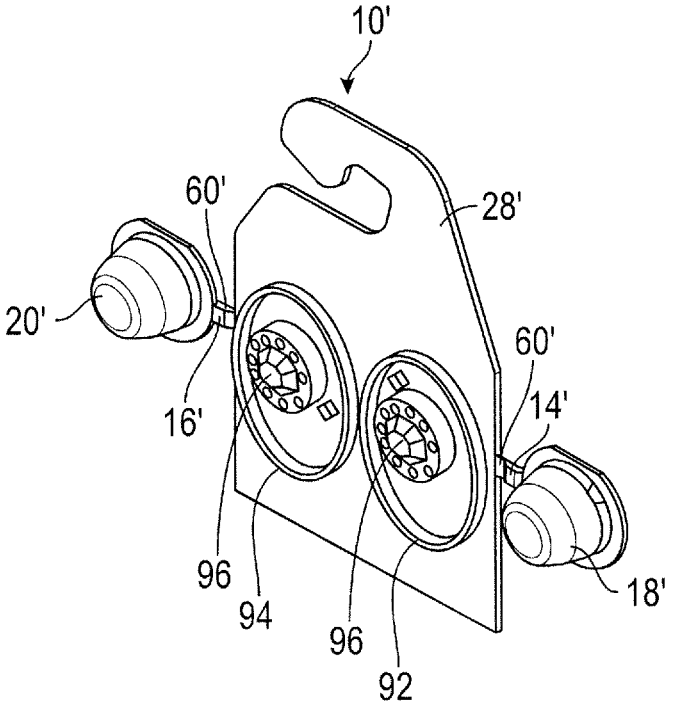
FIG. 9 is a perspective front view of the earring security display hanger in FIG. 8.
Figure 10:
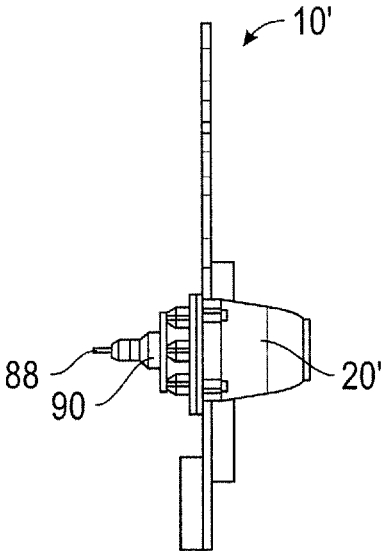
FIG. 10 is a side view of the earring security display hanger in FIG. 8.
Figure 11:
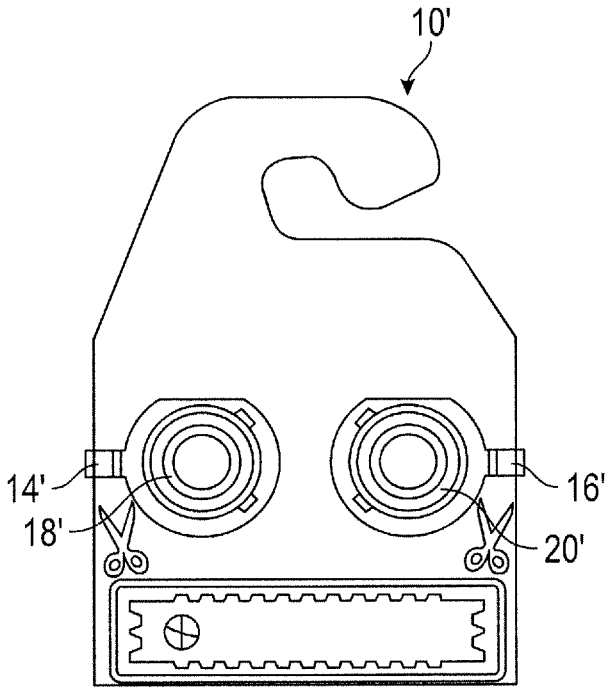
FIG. 11 is a rear view of the earring security display hanger in FIG. 8 in a locked/closed position.

Referring to more particularly to FIGS. 9 and 12, first and second rings 92, 94 are integrally formed on the second side 28' and protrude outwardly therefrom. The first and second rings 92, 94 surround earrings 96 such that they limit access to the earrings 96 to prevent separating them from the earring security display hanger 10'.

The earring security display hanger 10, 10' is made out of one or more materials having suitable properties for a desired application, including strength, weight, rigidity, etc. Plastic is generally preferred. It will be appreciated that other designs and configurations, such as a square cross section, could be used for the first and second closure members 18, 18', 20, 20', as deemed suitable for a given application factors such as earring type.

In use of the earring security display hanger 10, 10', first, in the open/unlocked position, earrings 44, 96 are placed to the first side 26, 26' of the body member 12, 12' by inserting earring hooks 54 through the earring holes 50, 52 or inserting stud earring posts 88 through the post receivers 80, 82. Then, by folding the first and second arms 14, 14', 16, 16' and first and second closure members 18, 18', 20, 20' along the foldlines 60, 60', and locking the first and second closure members 18, 18', 20, 20' by engaging each of the plurality of closure hooks 36, 36', 38, 38' with corresponding closure aperture 40, 40', 42, 42', the earring security display hanger 10, 10' is ready for suspension on a display hook or the like, such as a pegboard hook for retail display. Once a consumer purchases the earrings 44, 96, the consumer can remove them from the earring security display hanger 10, 10' by cutting or clipping the foldlines 60, 60' such that the closure members 18, 18', 20, 20' can be opened.

From the foregoing, it will be appreciated that an earring security display hanger according to the present invention may be used for anti-theft, tracking and inventory control, while providing the design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. An earring security display hanger comprising:

a generally flat body member having a first end, a second end, first and second sides extending from the first and second ends, a first edge, and a second edge;

first and second arms extending longitudinally from the first and second edges of the body member, respectively; and first and second closure members, each of the first and second closure members having a plurality of closure apertures and a closure channel integrally formed from the bottom of each closure member and extending downwardly therefrom, the first and second closure members connected to the body member by the first and second arms, respectively, such that the first arm positioned between the first closure member and the body member and the second arm positioned between the second closure member and the body member, wherein a plurality of first closure hooks and a plurality of second closure hooks are formed integrally from the first side of the body member and are configured to engage with the plurality of closure apertures to provide a locking mechanism, wherein each of the first and second arms includes a foldline to allow each closure member to be folded along the foldline to transition the earring security display hanger between open/unlocked and closed/locked positions, wherein each of the first and second closure members has a generally round cross section and includes a sidewall extending between open and closed ends, defining a closure member volume therebetween, with the open end having a flange formed thereabout, wherein, when the plurality of first and second closure apertures and the plurality of first and second closure hooks are engaged, they provide a locking mechanism, with a tip of each closure hook protruding outwardly from each closure aperture and engaging tightly with the flange.

2. The earring security display hanger of claim 1, wherein a plurality of first ribs and a plurality of second ribs are formed integrally from the first side of the body member adjacent to the plurality of first closure hooks and the plurality of second closure hooks, respectively, and protrude outwardly therefrom.

3. The earring security display hanger of claim 2, wherein the body member defines first and second earring holes that are positioned close to the plurality of first ribs and the plurality of second ribs, respectively, through which an earring hook of an earring could be inserted.

4. The earring security display hanger of claim 3, wherein first and second curved ribs are formed integrally from the second side of the body member immediately above the first and second earring holes, respectively, and protrude outwardly therefrom.

5. The earring security display hanger of claim 3, wherein, in the closed/locked position, the first and second closure members are configured such that, when the earring is secured to the earring security display hanger, an inner surface of each of the first and second closure members presses a portion of the earring hook against a corresponding rib.

6. The earring security display hanger of claim 1, wherein the closure channel defines a channel groove such that, in the closed/locked position, a bottom portion of the earring hook can be placed therewithin.

7. The earring security display hanger of claim 1, wherein each of the first and second closure members has a flat top cone shape.

8. The earring security display hanger of claim 1, wherein the body member includes a hook on the first end.

9. The earring security display hanger of claim 1, further comprising a security tag, which is attached to one of the sides of the body member.

10. The earring security display hanger of claim 9, wherein the security tag is used for tracking, inventory control and security.

11. The earring security display hanger of claim 9, wherein the security tag is a radio frequency identification (RFID) tag or an electronic article surveillance (EAS) device.

12. An earring security display hanger comprising:

a generally flat body member having a first end, a second end, first and second sides extending from the first and second ends, a first edge, and a second edge;

first and second arms extending longitudinally from the first and second edges of the body member, respectively; and first and second closure members, each of the first and second closure members having a plurality of closure apertures, the first and second closure members connected to the body member by the first and second arms, respectively, such that the first arm positioned between the first closure member and the body member and the second arm positioned between the second closure member and the body member, wherein a plurality of first closure hooks and a plurality of second closure hooks are formed integrally from the first side of the body member and are configured to engage with the plurality of closure apertures to provide a locking mechanism, wherein each of the first and second arms includes a foldline to allow each closure member to be folded along the foldline to transition the earring security display hanger between open/unlocked and closed/locked positions, wherein each of the first and second closure members has a generally round cross section and includes a sidewall extending between open and closed ends, defining a closure member volume therebetween, with the open end having a flange formed thereabout, wherein, when the plurality of first and second closure apertures and the plurality of first and second closure hooks are engaged, they provide a locking mechanism, with a tip of each closure hook protruding outwardly from each closure aperture and engaging tightly with the flange, wherein first and second rings are integrally formed from the second side of the body member and protrude outwardly therefrom such that they limit access to earrings to prevent separating them from the earring security display hanger.

13. An earring security display hanger comprising:

a generally flat body member having a first end, a second end, first and second sides extending from the first and second ends, a first edge, and a second edge;

first and second arms extending longitudinally from the first and second edges of the body member, respectively; and first and second closure members, each of the first and second closure members having a plurality of closure apertures, the first and second closure members connected to the body member by the first and second arms, respectively, such that the first arm positioned between the first closure member and the body member and the second arm positioned between the second closure member and the body member, wherein a plurality of first closure hooks and a plurality of second closure hooks are formed integrally from the first side of the body member and are configured to engage with the plurality of closure apertures to provide a locking mechanism, wherein each of the first and second arms includes a foldline to allow each closure member to be folded along the foldline to transition the earring security display hanger between open/unlocked and closed/locked positions, wherein each of the first and second closure members has a generally round cross section and includes a sidewall extending between open and closed ends, defining a closure member volume therebetween, with the open end having a flange formed thereabout, wherein, when the plurality of first and second closure apertures and the plurality of first and second closure hooks are engaged, they provide a locking mechanism, with a tip of each closure hook protruding outwardly from each closure aperture and engaging tightly with the flange, wherein first and second post receivers are formed integrally from the first side of the body member and extend between first and second openings such that they provide adequate friction fit for earring posts.

* * * * *